US012209748B2

(12) United States Patent
Cook

(10) Patent No.: US 12,209,748 B2
(45) **Date of Patent: *Jan. 28, 2025**

(54) PILOT ASSEMBLIES AND METHODS FOR ENCLOSED GROUND FLARES AND ELEVATED FLARE STACKS

(71) Applicant: Surefire Pilotless Burner Systems LLC, Farmington, NM (US)

(72) Inventor: Ronnie Cook, Farmington, NM (US)

(73) Assignee: Surefire Pilotless Burner Systems LLC, Farmington, NM (US)

( * ) Notice: Subject to any disclaimer, the term of this patent is extended or adjusted under 35 U.S.C. 154(b) by 507 days.

This patent is subject to a terminal disclaimer.

(21) Appl. No.: 17/590,820

(22) Filed: Feb. 2, 2022

(65) Prior Publication Data

US 2022/0154931 A1 May 19, 2022

Related U.S. Application Data

(63) Continuation-in-part of application No. 16/247,553, filed on Jan. 14, 2019, now Pat. No. 11,274,827.

(60) Provisional application No. 62/619,763, filed on Jan. 20, 2018.

(51) Int. Cl.

| | |
|---|---|
| ***F23G 7/08*** | (2006.01) |
| ***F23Q 7/10*** | (2006.01) |
| ***F23Q 9/14*** | (2006.01) |

(52) U.S. Cl.
CPC ..... *F23G 7/085* (2013.01); *F23Q 7/10* (2013.01); *F23Q 9/14* (2013.01)

(58) Field of Classification Search
CPC ... F23G 7/08; F23G 7/085; F23Q 9/14; F23Q 7/10; F23Q 9/00; F23Q 9/08; F23Q 9/10; F23D 2207/00; F23D 2227/22
See application file for complete search history.

(56) References Cited

U.S. PATENT DOCUMENTS

| | | | | |
|---|---|---|---|---|
| 4,147,498 | A | 4/1979 | Clarke | |
| 6,840,761 | B2 | 1/2005 | Hong | |
| 9,267,686 | B1 | 2/2016 | Little et al. | |
| 2006/0172238 | A1 | 8/2006 | Cook | |
| 2012/0282555 | A1 | 11/2012 | Cody | |
| 2016/0209032 | A1 | 7/2016 | Loveless | |
| 2017/0130959 | A1* | 5/2017 | Guerra | F23D 14/24 |
| 2017/0284669 | A1 | 10/2017 | Cook | |
| 2019/0242575 | A1 | 8/2019 | Fisher et al. | |
| 2020/0025372 | A1 | 1/2020 | Cassidy | |

* cited by examiner

*Primary Examiner* — Ko-Wei Lin
(74) *Attorney, Agent, or Firm* — Paradice & Li LLP; Anand S. Chellappa

(57) ABSTRACT

Pilot assemblies comprising a fire path tubing and pilot tubing in fluid communication through a pilot nozzle for burning waste gases in enclosed ground flares and elevated flare stacks are disclosed. A plurality of flame segments is generated using a hot surface ignition element in the fire path tubing and ignites fuel/air mixture flowing through the pilot tubing into a pilot nozzle to produce a reliable pilot flame. Methods for operating the pilot assemblies are disclosed.

31 Claims, 10 Drawing Sheets

PILOT ASSEMBLIES AND METHODS FOR ENCLOSED GROUND FLARES AND ELEVATED FLARE STACKS

CROSS REFERENCE TO RELATED APPLICATIONS

This application is a continuation-in-part of U.S. patent application Ser. No. 16/247,553 filed Jan. 14, 2019, which is related to and claims the benefit of and priority to U.S. Provisional Patent Application No. 62/619,763, filed Jan. 20, 2018, and titled "Pilot Assemblies and Methods for Elevated Flare Stacks," which are hereby incorporated by reference in each of their entireties.

FIELD

The present invention relates to combustion of waste gases in oil and gas fields using enclosed ground flares and elevated flare stacks. In particular, it relates to pilot assemblies and methods that comprise a fire path tubing for generating a plurality of flame segments using a hot surface ignition element, which then ignites fuel/air mixture in a pilot assembly nozzle to produce a reliable pilot flame.

BACKGROUND

Gas flaring is an important unit operation employed during the exploration, production and processing of natural gas and oil from oil and gas wells. Flaring is regulated by federal and state regulations in the U.S. Flaring is done after an oil/gas well is drilled during well production testing until the flow of liquids and gas from the well, oil and gas compositions, and pressures are stabilized. Flaring is also done as a safety measure to release gas from storage vessels and other process equipment to prevent fire and explosions during maintenance and repairs of process units and wells. Finally, flaring is done during treatment processes such as oil/water separators, and dehydrators (or treaters), wherein the waste gas cannot be efficiently captured. A flare system comprises of a flare stack, piping that feed gas to the stack, and an ignition system.

Natural gas is a byproduct formed during oil extraction from oil wells and is typically referred to as wellhead gas. Wellhead gas comprises a mixture of methane, ethane, propane, nitrogen, carbon dioxide, and water. In addition, wellhead gas may contain varying amounts of sulfur compounds such as hydrogen sulfide. Ignition of waste gases in flare stacks is initiated and controlled using a burner management system (BMS). The burner management system controls the operation of an igniter. Ignition in turn could be achieved by spark ignition or sparkless ignition. Flare stacks require a pilot flame to ensure that any waste gases released are burnt efficiently. In the case of spark ignition, the sparking tips require periodic cleaning to remove carbon accumulation formed as a byproduct of combustion. Further, periodic adjustment is required to maintain the spark gap between the two electrodes in a spark igniter. Therefore, there is an increasing interest in using sparkless ignition for piloted systems.

Enclosed ground flares (also known as combustors) are used to burn waste gases from process plants and oil and gas well sites. At well sites, waste gases may comprise the vapor that is periodically released from oil and gas hold tanks in order to maintain tank pressure. Ground flares eliminate visible flames, noise and smoke that are seen in elevated flare stacks. Enclosed ground flares may comprise a cylindrical combustion chamber, which may be refractory lined. Waste gas, often at about 0.5 to 8 ounce per sq. in. gas pressure, may be fed to one or more burners disposed near the bottom of the combustion chamber and burnt. The combustion chamber conceals the flames from the burners. Since flow of waste gas to these burners may be intermittent, a robust pilot assembly is needed to light the burners and to ensure that waste gases are destroyed to minimize environmental impact. In larger enclosed ground flares, the bottom of the combustion chamber may be concealed using structures such as a wind fence that block radiation from the burners and also improve air supply and distribution to the burners.

In elevated flare stacks, flame generators for igniting waste gases in a pilot line have been in service for a number of years and sold by companies such as Argo Flare Services (United Kingdom) and Hero Flare (Kellyville, OK). Flames may be generated using compressed air pilot systems or naturally aspirated systems. In the compressed air system, compressed air and fuel gas are metered into a mixer located in a single pilot tubing assembly at near grade level. A sparking device located in the pilot nozzle ignites the fuel and generates the fire ball. The pilot line is purged with the fuel prior to ignition. The fire balls travel to the flare tip and ignites the waste gases. Since the composition of the waste gases may change from time to time and requires balancing of air/fuel ratios, a supplemental fuel such as propane may be used in the pilot to insure reliable fireball generation. Instead of using compressed air, ambient air may be drawn into the mixer in the pilot line using a venturi effect caused by the fuel flow. These commercial systems generate a spark to ignite the air/fuel mixture and generate the flame front. As is well known, sparking rods require frequent maintenance. Hero Flare, for example, provides for pilots that may be raised and lowered from grade level to allow for maintenance.

An alternate to spark ignition is sparkless ignition using hot surface ignition (HSI) elements. U.S. Patent Publication No. US2012/0282555 titled "HOT SURFACE IGNITION ASSEMBLY FOR USE IN PILOTS FOR FLARING INCINERATION, AND PROCESS BURNERS," describes a combustion chamber for generating a fireball to ignite a pilot. Ignition gas (fuel) is introduced to a combustion chamber and draws air into the combustion chamber. Fuel and air are mixed and ignited by an HSI element. Combustion initiates a flame front, which may travel through a pipe until it ignites flare gases. This application does not disclose where the combustion chamber is located in the single pilot line assembly. Also, disclosed is a pilot assembly in which the HSI element is located in the pilot nozzle near the tip of the flare stack. Pilot fuel flows through a mixer where the gas is mixed with air drawn in by the fuel flow. The fuel/air mixture then reaches the pilot head (nozzle) where it is ignited by the HSI assembly, which is affixed to a head. A power source connected to a junction box provides power to the HSI element.

The Applicant has tested pilot assemblies that comprise a single pilot line assembly in which the HSI element is located in the pilot line nozzle that was located proximate to the flare stack tip. In this arrangement, the HSI is also used as a flame sensor. Methods for using the HSI element as a flame sensor are disclosed in commonly owned U.S. Patent Publication No. US2017/0284669, which is incorporated by reference herein in its entirety. In this assembly, fuel/air mixture flows up the pilot line and ignites upon contact with the energized HSI element. The durability of the HSI element, as used in this arrangement, was found to be poor because the HSI element was exposed to the extreme heat produced by the pilot flame, and because the HSI element was also exposed to weather conditions that caused thermal shock (e.g., caused by rain droplets) to the HSI element. The Applicant has also tested pilot assemblies that comprise a single pilot line and a spark igniter (in place of the HSI element) located in the pilot line nozzle that was positioned proximate to the flare stack tip. This arrangement was also plagued with unreliable pilot ignition because the spark igniter was rapidly covered with soot from the flare flame that burns rich, and deposits soot and debris on to the sparker rod causing a barrier for the spark to ground, which in turn caused the ignition coil to burn out frequently. Coil burnout results in downtime and increases maintenance cost. In addition, well operators also suffer from fines imposed by regulatory agencies because unburnt gases are exhausted to the atmosphere when flares are not functioning due to a pilot failure. Improved pilot assemblies and methods for operating the same for elevated flare stacks are therefore needed.

Efficient pilot assemblies and methods for enclosed ground flares and elevated flare stacks in conjunction with a suitable burner management system are therefore needed to improve the efficiency and reduce down time at well sites and other applications such as fuel and chemical processing units in refineries and petrochemical plants, chemical processing, and landfill gas production units.

BRIEF DISCLOSURE

The exemplary pilot assembly comprising dual lines, namely, a fire path tubing and a pilot tubing as disclosed herein overcomes the deficiencies described above. The HSI element in the pilot assembly is disposed in the fire path tubing at a distance below or away from the pilot nozzle and is therefore not exposed to atmospheric elements and extreme heat generated by the pilot flame in the nozzle. Flame temperature is sensed using a thermocouple. The positioning of the thermocouple in the cooler part of the flame inside the disclosed pilot nozzle improves the durability of the thermocouple. The thermocouple in prior art pilot assemblies for elevated flare stacks, for example in U.S. Patent Publication No. US2012/0282555 is attached to the external surface of the pilot nozzle, which exposes the thermocouple to extreme heat and results in frequent failure. Changing the thermocouple is not a trivial task because the pilot nozzle is often located 20 ft. to 100 ft. from grade level.

Disclosed in an exemplary pilot assembly for igniting waste gases in enclosed ground flares comprising a fire path tubing having an inlet end and an outlet end and having a fuel inlet disposed at the inlet end, a pilot tubing having an inlet end and an outlet end and having a fuel inlet disposed at the inlet end wherein each of the fire path tubing and pilot tubing are characterized by a bend such that the inlet end and outlet end of each tubing are not disposed along a straight line, a pilot nozzle configured to receive the pilot tubing at a first nozzle inlet and the fire path tubing at a second nozzle inlet, and a hot surface igniter element (HSI) disposed at a distance away from the nozzle and in fluid communication with the fire path tubing wherein the tip of the HSI element is offset whereby the tip does not extend inside the fire path tubing into the flow path of the fuel/air mixture. A plurality of flame segments generated in the fire path tubing by igniting a first premixed fuel/air mixture by the HSI element travel through the fire path tubing and ignites a second premixed fuel/air mixture entering the nozzle through the pilot tubing to create a pilot flame for igniting waste gases. The pilot tubing may be disposed substantially parallel to the fire path tubing. The inlet end and outlet end of each tubing may be disposed substantially orthogonal to each other. The first and second nozzle inlets may be disposed substantially orthogonal to each other. The pilot nozzle may be configured to receive a thermocouple to detect the presence of the pilot flame. The nozzle may be adapted to receive the thermocouple through an opening disposed near the first nozzle inlet and wherein the tip of the thermocouple is disposed below the midpoint of the length of the nozzle. The hot surface igniter element may be cylindrical. The hot surface igniter element may be energized using DC voltage. The HSI element tip offset may about 0.8 in. The HSI element tip may be offset by between about 0.5 in. and about 1.05 in. The nozzle may be cylindrical in shape. The nozzle may be made of at least one of Type 304 Stainless Steel, Type 316 Stainless Steel, and Type 310 Stainless Steel.

An exemplary pilot assembly for enclosed ground flares may further comprise a first venturi mixer disposed in the fire path tubing upstream of the HSI element and a second venturi mixer disposed in the pilot tubing upstream of the nozzle wherein the first and second mixers provide first and second fuel/air mixtures to the fire path tubing and pilot tubing respectively. Each of the first and second venturi mixer may comprise an inlet end and outlet end disposed opposite to the inlet end, an orifice bracket adapted to mate with the inlet end of the mixer and adapted to receive an orifice component connected to a fuel supply, a neck region disposed downstream of the inlet end and in fluid communication with a throat region, wherein the diameter of the neck region is greater than the diameter of the throat region, and, a diverging section disposed between the throat region and the outlet end of the mixer, wherein at least 50% of the length of the orifice component is enclosed within the walls of the mixer at the inlet end. Each mixer may be made of at least one of precipitation-hardened aluminum 6061 alloy, cast iron, Type 304 Stainless Steel, and cast aluminum.

In an exemplary pilot assembly for enclosed ground flares, the nozzle may further comprise a fuel/air mixture distributing element insert adapted to receive the outlet end of the pilot tubing wherein the distributing element comprises a neck region with a first end and a second end disposed opposite to the first end wherein the first end is adapted to receive the pilot tubing; and a throat region having a first end connected to the second end of the neck region and a second end wherein the diameter of the throat region at the first end is greater than the diameter of the throat region at the second end, and wherein fuel/air mixture flows through the neck region and exits through the second end of the throat region. The throat region of the fuel/air mixture distributing element may further comprise a plurality of holes disposed below the second end. The diameter of the holes may be about 0.125 inch.

Disclosed is an exemplary pilot flame light-off sequence for pilot assembly for enclosed ground flares comprising energizing the HSI igniter during an ignition period, initiating fuel flow to the pilot assembly and generating a plurality of flame segments in the fire path tubing by igniting the fuel/air mixture using the energized HSI element wherein the plurality of flame segments enters the nozzle and ignites the fuel/air mixture entering the nozzle from the pilot tubing, measuring the change in flame temperature ($\Delta T$) in the nozzle relative to ambient temperature using the thermocouple after an interval period; and, if the $\Delta T$ is less than a predetermined set point temperature shutting of fuel flow to the pilot assembly and repeating the sequence. The ignition period may be between about 8 seconds and 15 seconds. The predetermined set point temperature may be about 100° C. The interval period may be about 30 seconds. The sequence may further comprise the steps of measuring the flame temperature at intervals of about 10 seconds if ΔT is above the predetermined set point temperature, recording a maximum temperature measured by the thermocouple, shutting off fuel flow if the flame temperature decreases by at least 1% from the maximum temperature, and repeating the light off sequence up to three times after which the light-off sequence is terminated if the pilot flame is not sensed. The maximum temperature may be between about 600° F. and about 1500° C. depending on the heating value of the fuel.

Disclosed is an exemplary pilot assembly for igniting waste gases in an elevated flare stack, the pilot assembly comprising a fire path tubing, a pilot tubing, a pilot nozzle configured to receive the pilot tubing at a first nozzle inlet and the fire path tubing at a second nozzle inlet wherein the first and second nozzle inlets are disposed substantially orthogonal to each other, and a hot surface ignition element (HSI) disposed at a distance below the second nozzle inlet in fluid communication with the fire path tubing wherein the tip of the HSI element is offset whereby the tip of the HSI element does not extend inside the fire path tubing into the flow path of the fuel/air mixture and wherein the HSI element offset is dependent on the length of the pilot assembly. A plurality of flame segments generated in the fire path tubing by igniting a first premixed fuel/air mixture by the HSI element travel up the fire path tubing and ignites a second premixed fuel/air mixture entering the nozzle through the pilot tubing to create a pilot flame for igniting waste gases flowing through the elevated flare stack and. The length of the pilot assembly may be less than about 100 in, in which case, the HSI offset may be between about 0.5 in. and about 1.05 in. The offset may be about 0.8 in. The length of the pilot assembly may be at least about 200 in., in which case, the offset may be between about 2.85 in. and about 3.35 in. The offset may be about 3.1 in.

Other features and advantages of the present disclosure will be set forth, in part, in the descriptions which follow and the accompanying drawings, wherein the preferred aspects of the present disclosure are described and shown, and in part, will become apparent to those skilled in the art upon examination of the following detailed description taken in conjunction with the accompanying drawings or may be learned by practice of the present disclosure. The advantages of the present disclosure may be realized and attained by means of the instrumentalities and combinations particularly pointed out in the appendant claims.

DRAWINGS

The foregoing aspects and many of the attendant advantages of this disclosure will become more readily appreciated as the same becomes better understood by reference to the following detailed description, when taken in conjunction with the accompanying drawings, wherein:

FIG. 1. Schematic diagram of an exemplary pilot assembly for elevated flare stacks.

FIGS. 2A-E depict (A) perspective view of an exemplary nozzle for a pilot assembly, (B) cross sectional view of nozzle, (C) cross sectional side view of nozzle, (D) cross sectional side view of nozzle insert and (E) bottom view of insert, respectively.

FIGS. 3A-C depict (A) a perspective view of an exemplary fuel/air mixer, (B) cross sectional side view of an exemplary fuel/air mixer, and (C) side view and front view of an exemplary orifice bracket of the mixer, respectively.

Figure 4:
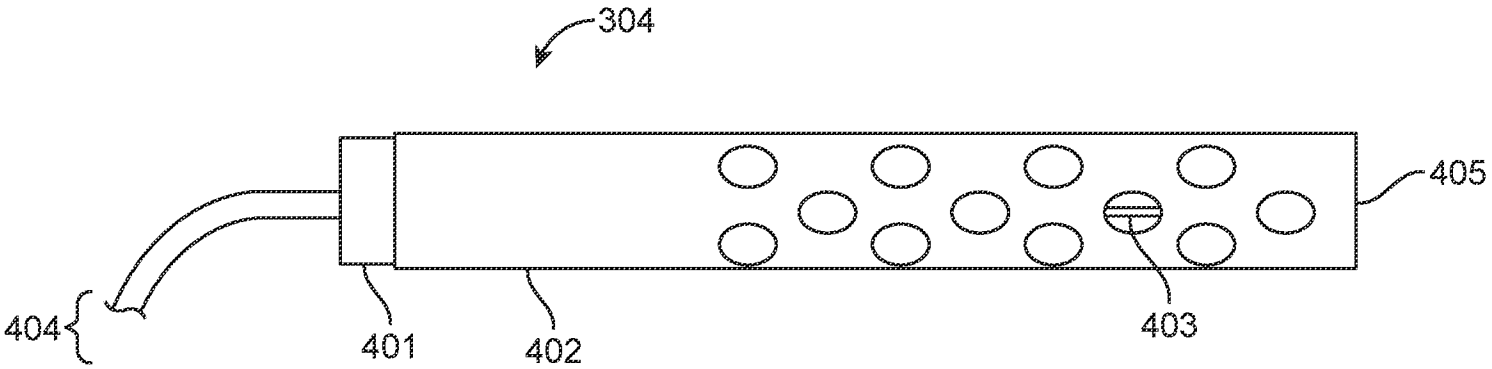

FIG. 4. Schematic diagram of an exemplary hot surface ignition (HSI) element.

Figure 5:
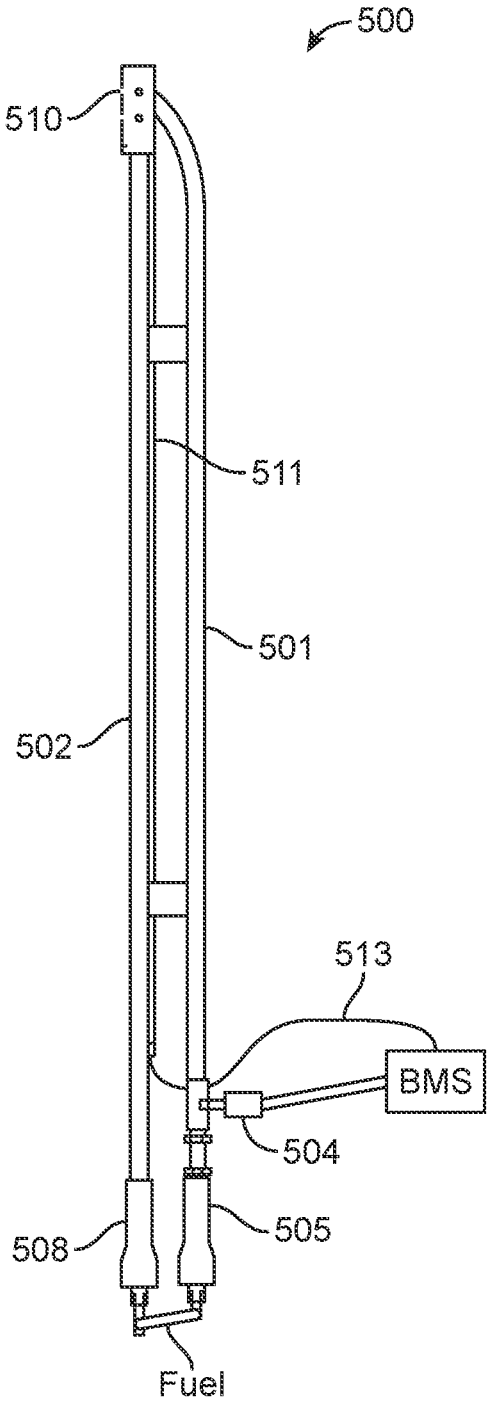

FIG. 5. Schematic diagram of an exemplary pilot assembly for elevated flare stacks with a spark igniter.

Figure 6:
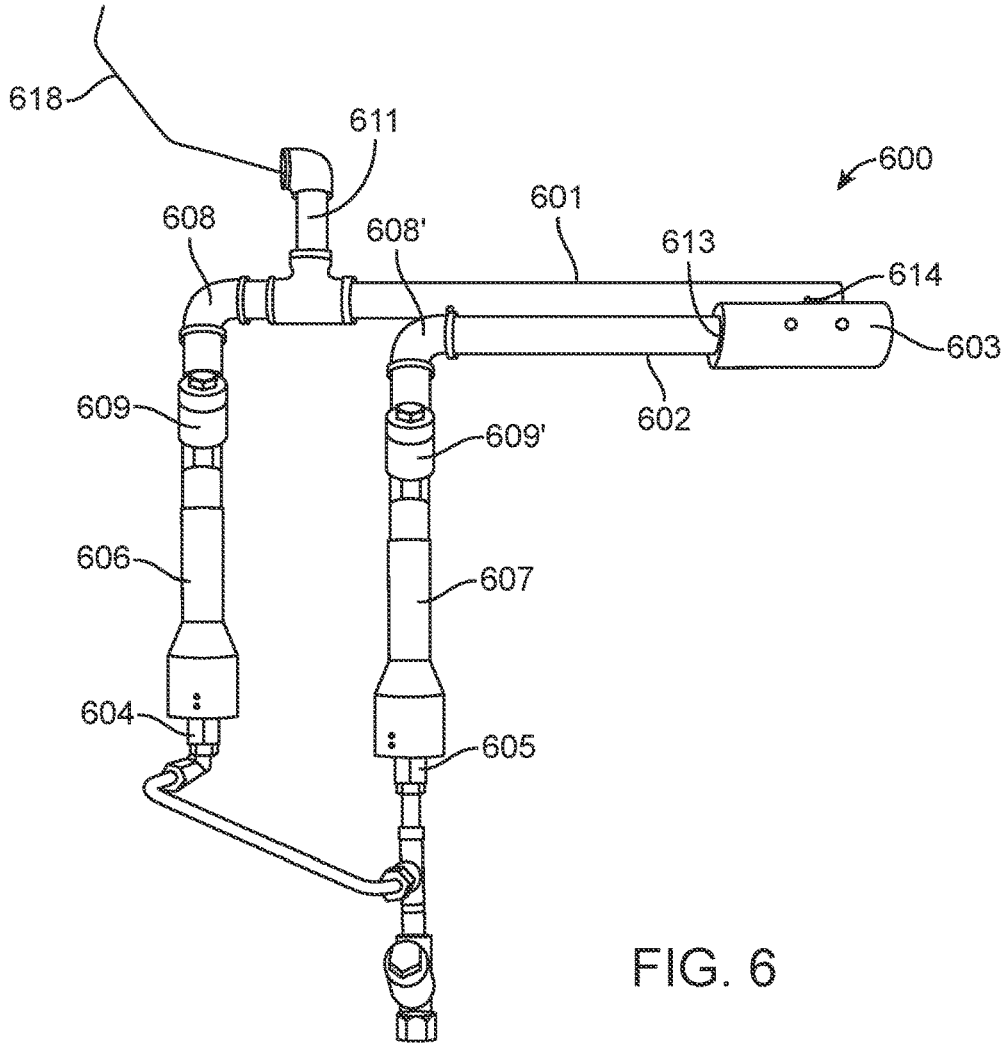
Figure 7:
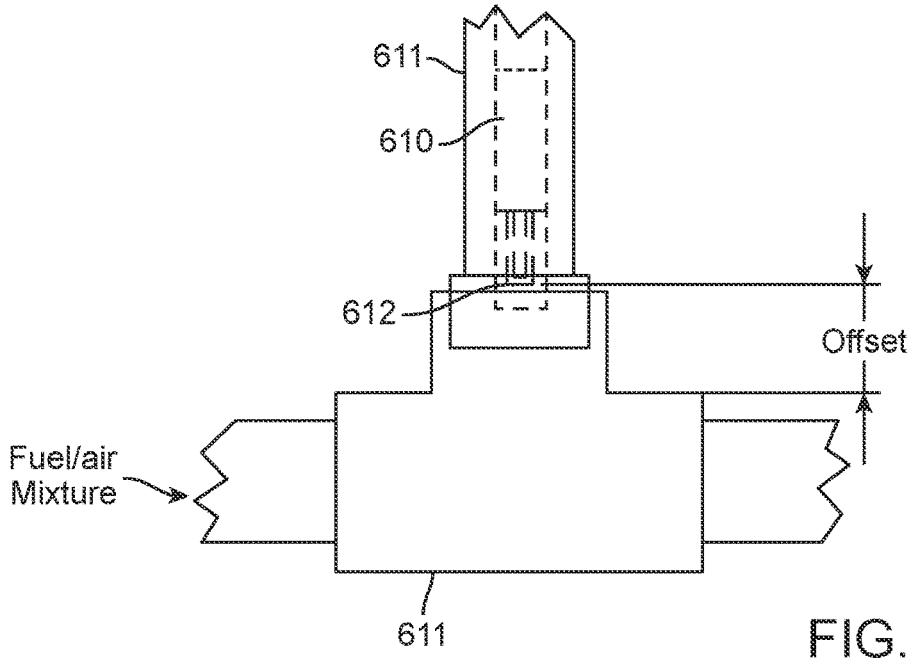

FIG. 6. Schematic diagram of an exemplary pilot assembly for enclosed ground flares FIG. 7. Schematic diagram showing exemplary HSI element offset in an exemplary pilot assembly.

Figure 8A:
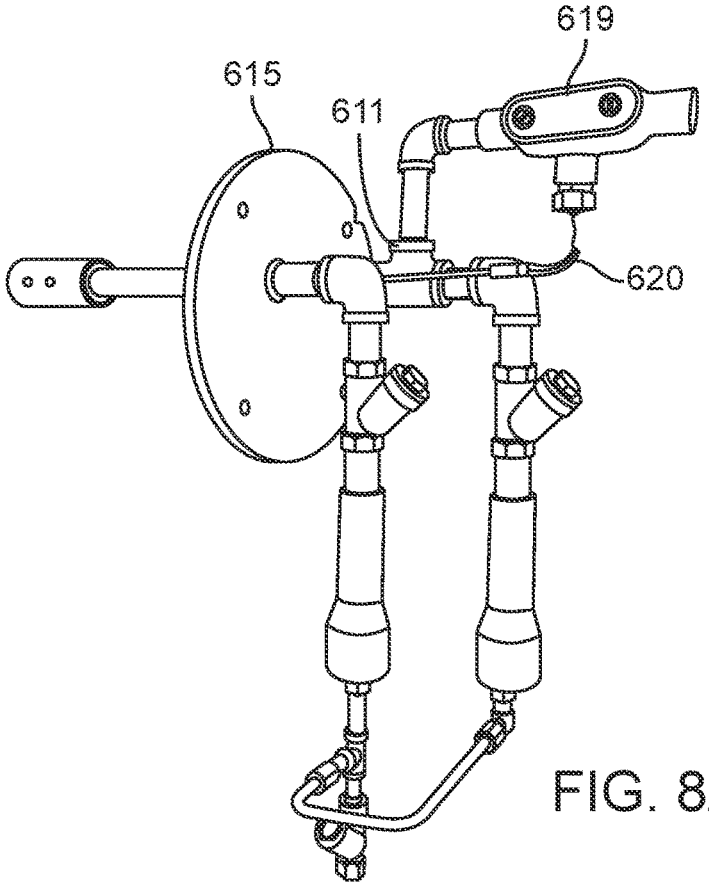
Figure 8B:
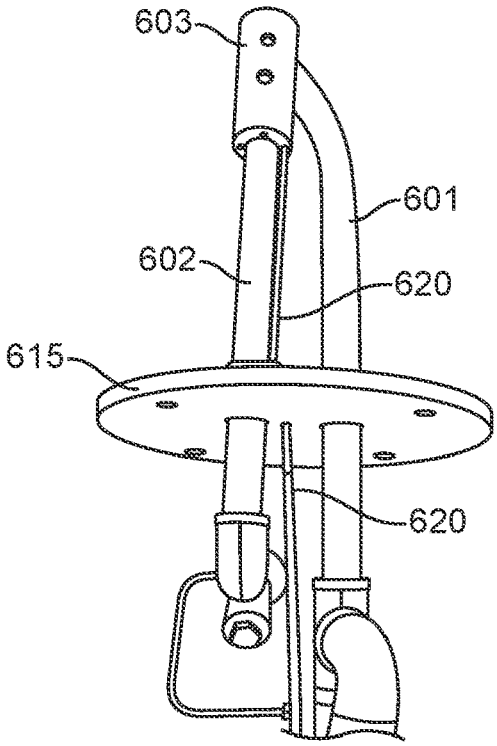

FIGS. 8A-B. Schematic diagram of another exemplary pilot assembly for enclosed ground flares.

Figure 9:
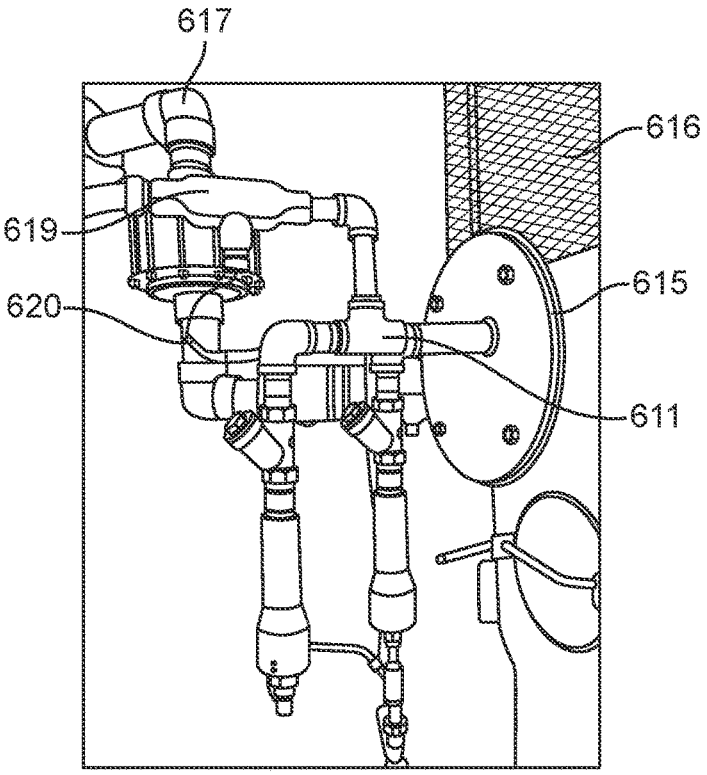

FIG. 9. Schematic diagram of an exemplary pilot assembly assembled in an enclosed ground flare combustion chamber FIG. 10. Schematic diagram of another exemplary pilot assembly for elevated ground flares.

All reference numerals, designators and callouts in the figures are hereby incorporated by this reference as if fully set forth herein. The failure to number an element in a figure is not intended to waive any rights. Unnumbered references may also be identified by alpha characters in the figures and appendices.

The following detailed description includes references to the accompanying drawings, which form a part of the detailed description. The drawings show, by way of illustration, specific embodiments in which the pilot assembly and methods may be practiced. These embodiments, which are to be understood as "examples" or "options," are described in enough detail to enable those skilled in the art to practice the present invention. The embodiments may be combined, other embodiments may be utilized, or structural or logical changes may be made without departing from the scope of the invention. The following detailed description is, therefore, not to be taken in a limiting sense and the scope of the invention is defined by the appended claims and their legal equivalents.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation. For construing the scope of the term "about," the error bounds associated with the values (dimensions, operating conditions etc.) disclosed is ±10% of the values indicated in this disclosure. The error bounds associated with the values disclosed as percentages is ±10% of the percentages indicated. The word "substantially" used before a specific word includes the meanings "considerable in extent to that which is specified," and "largely but not wholly that which is specified."

DETAILED DISCLOSURE

Particular aspects of the invention are described below in considerable detail for the purpose for illustrating its principles and operation. However, various modifications may be made, and the scope of the invention is not limited to the exemplary aspects described.

Figure 1:
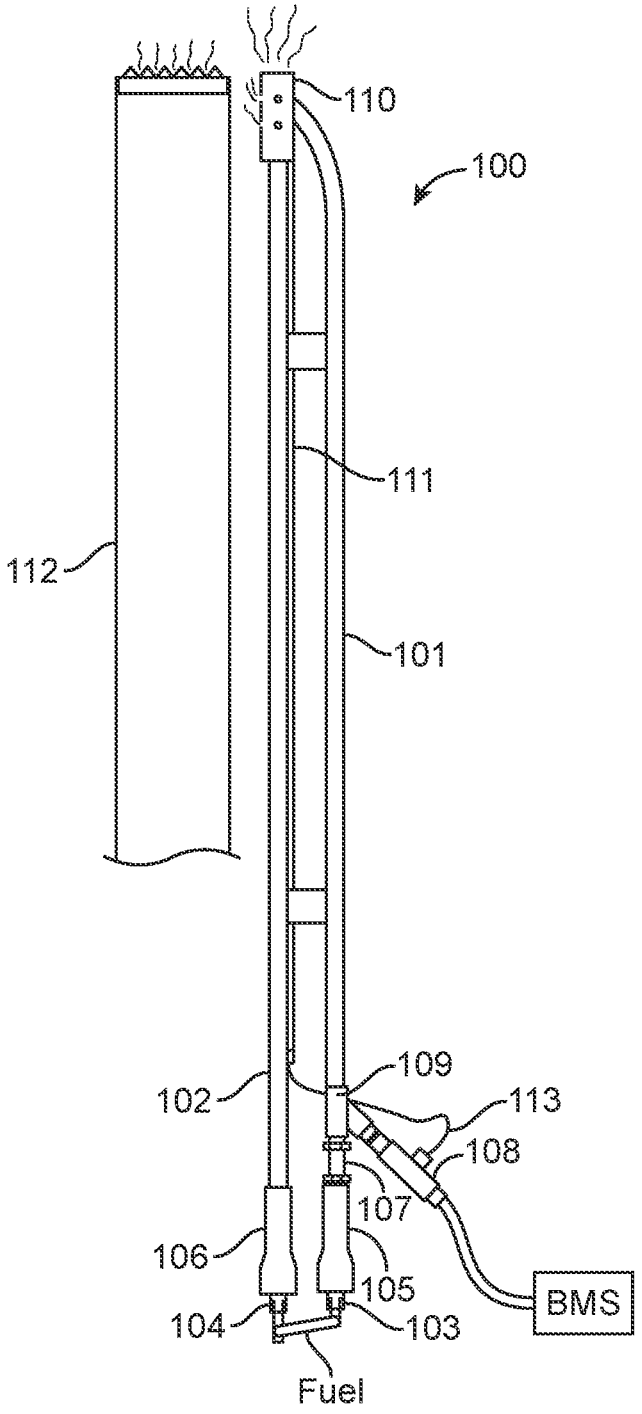

FIG. 1 illustrates various features of an exemplary pilot assembly 100 for use in elevated flare stacks. The assembly comprises a plurality of tubings, namely, a fire path tubing 101 and a pilot tubing 102 that are preferably disposed substantially parallel to each other. The tubings are generally ¾ in. pipe having outer diameter of about 1.05 in. and made of Type 304 Stainless Steel. Tubings made of other alloys such as Type 316 Stainless Steel, Inconel, and the like may be used. The pilot assembly in turn is disposed substantially parallel to a flare stack 112. The pilot assembly may be between about 2 ft. and about 20 ft. in length, as measured from nozzle end 211 (FIG. 2C) to fuel inlet 103 or 104 and may be elevated using suitable mechanisms to the desired height from grade level such that pilot nozzle is positioned substantially proximate to the flare stack tip. Preferably, pilot nozzle 110 is about level with the flare stack tip. Flare stacks vary in height and may be 5 to 50 ft. in height and could even exceed 100 ft. in height. Fuel to the pilot assembly is typically off-gas from treatment units such as water/oil separators. Water/oil separators may be physical separators or heater treaters. The fuel is typically dehydrated and fed to the pilot assembly at a pressure of about 10 psig to 14 psig. Waste gases from oil storage or water storage tanks at well sites may vary in composition and are available at low pressure (about 0.5 to 8 ounce per sq. in.). Waste gases are combusted. Because of varying gas composition and low pressures, waste gases are generally not suitable to be used as a fuel in pilot systems.

The fuel to the pilot assembly is split into two streams and fed to fuel inlet orifice component 104 in the fire path tubing and to fuel inlet orifice component 103 in the pilot tubing. Splitting of fuel flow to the pilot tubing and the fire path tubing in a desired ratio is achieved by selecting the orifice sizes. Preferably, 70% of the fuel feed is routed to the pilot tubing. To achieve this split the size of orifice component 104 may be about 0.040 in. and that of orifice component 103 may be about 0.025 in. Orifice components 103 and 104 and disposed at the bottom end (inlet end) of mixers 105 and 106 respectively. In each mixer, fuel is premixed (naturally aspirated) with air as the fuel flows through the mixer.

The fuel/air mixture exits mixer 105 in fire path tubing 101, flows through a reducer element 107 (typically ¾ in.×½ in.) and is ignited by hot surface igniter (HSI) 108. Ignitor 108 may be inserted into fitting 109 (preferably Y-shaped, a T-fitting may also be used) connected to tubing 101 and may be sealed using electrical seal-off cement. Alternately, igniter 108 may be inserted into an opening provided in the fire path tubing. Fitting 109 should be understood to be part of the fire path tubing. The igniter is preferably positioned such that tip 405 (FIG. 4) is facing upwards towards nozzle 110 of the pilot assembly. The tip of the HSI element does not extend inside tubing 101 into the flow path of the fuel/air mixture. Instead, it is offset from the wall of the fire path tubing that receives the HSI element. If fitting 109 is used, the tip is offset from the vertical wall (wall of fitting 109 that is substantially parallel to the fire path tubing wall) of fitting 109 that connects to fire path tubing 101. The offset is preferably less than about 0.75 in. away from the wall of the fire path tubing that receives the HSI element (or wall of fitting 109 that is substantially parallel to the fire path tubing wall). HSI element 108 may be positioned to be flush with the wall of the fire path tubing that receives the HSI element. Preferably, the HSI element tip is offset about 0.5 in. from the wall of the fire path tubing that receives the HSI element. The positioning of the HSI tip as described above does not impede the flow of fuel/air mixture in fire path tubing 101. It also generates a plurality of flame segments by the ignition of the fuel/air mixture by the energized HSI igniter 108, which travel up tubing 101 towards nozzle 110. Flame segments comprise one or more flame regions separated by one or more slugs of fuel/air mixture that flow up tube 101 towards nozzle 110. When the igniter 108 is not energized, a continuous flow of fuel/air mixture is realized in tubing 101. As shown in FIG. 1, igniter 108 is disposed in fire path tubing 101 at a distance from nozzle 110. The distance between igniter 108 and nozzle 110 is not a critical parameter and may vary depending upon the length of pilot assembly 100.

Igniter 108 comprises an igniter heating element 403 (FIG. 4) that is substantially enclosed in a high temperature ceramic body 401. Wires 404 are electrically connected to igniter heating element 403 and are used to energize the igniter heating element using preferably a DC (direct current) electrical source. A portion of element 403 protrudes from the ceramic body 401. A high temperature alloy guard (e.g., Inconel guard) 402 protects the ceramic body, and the exposed part of heating element 403. The Inconel guard is preferably 0.4 in. to 0.5 in. in diameter, and more preferably 0.4 in. to 0.45 in. in diameter. HSI assembly (not including the length of the wires 404) is preferably between about 2 in. and about 3 in. in length, and more preferably between about 2 in. and about 2.5 in. in length. The length of the heating element 403 that protrudes from the ceramic body 401 is preferably between about 0.3 in. and about 0.6 in., and more preferably between about 0.4 in. and about 0.55 in. Ignition wiring 404 connected to the HSI element 108 is rated to withstand at least 1000° F. The wiring is routed to a burner management system (BMS). When the HSI element is energized, it heats up to 2800° F. and ignites fuel/air mixture to generate flame segments in tubing 101 as previously described. Reducer 107 increases the velocity of the fuel/air mixture and provides the driving force to push the flame segments up tubing 101 and through slotted opening 202 of pilot nozzle 110.

Figure 2A:
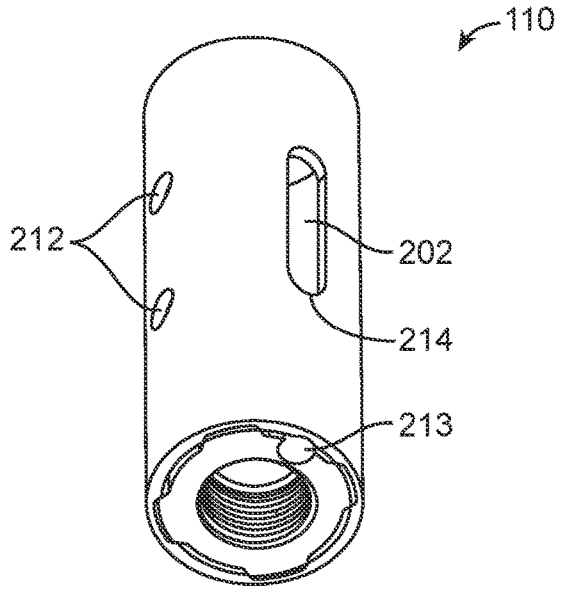
Figure 2B:
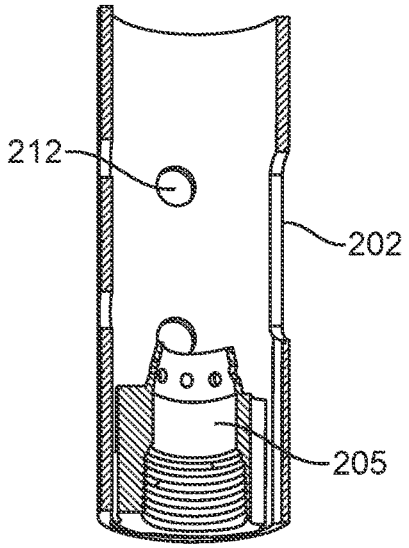
Figure 2C:
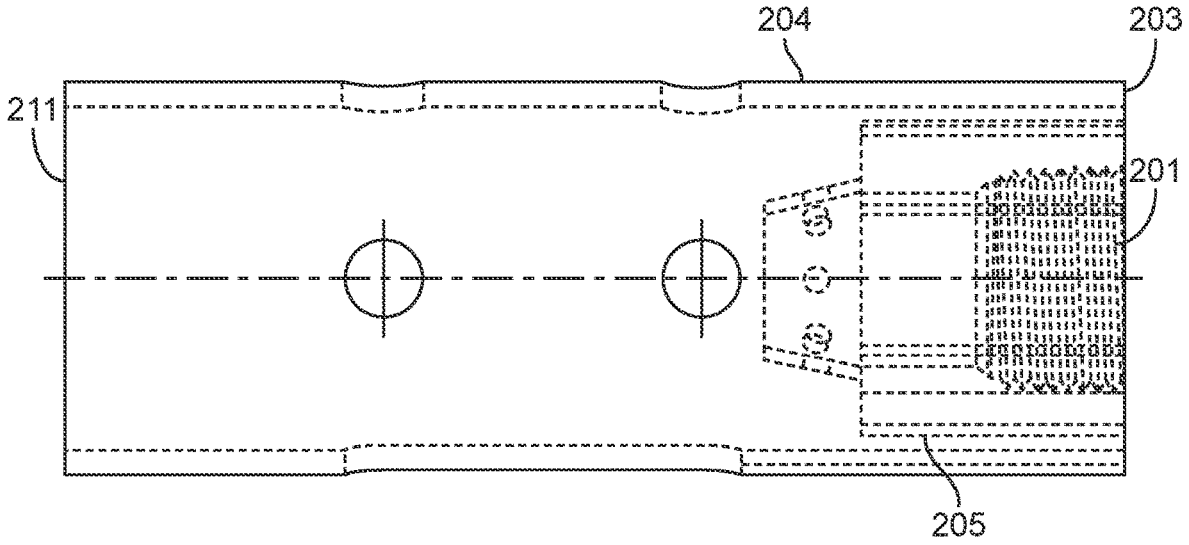
Figure 2D:
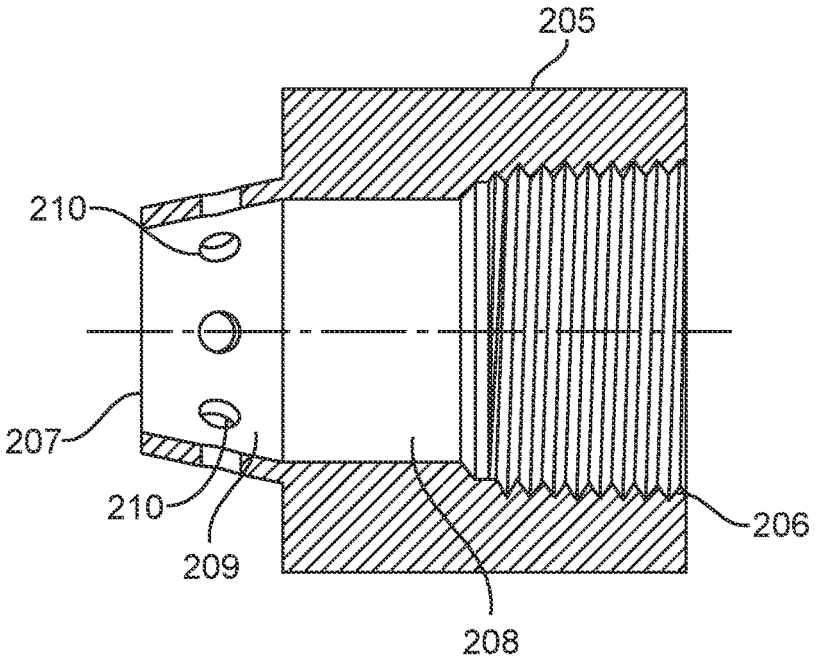
Figure 2E:
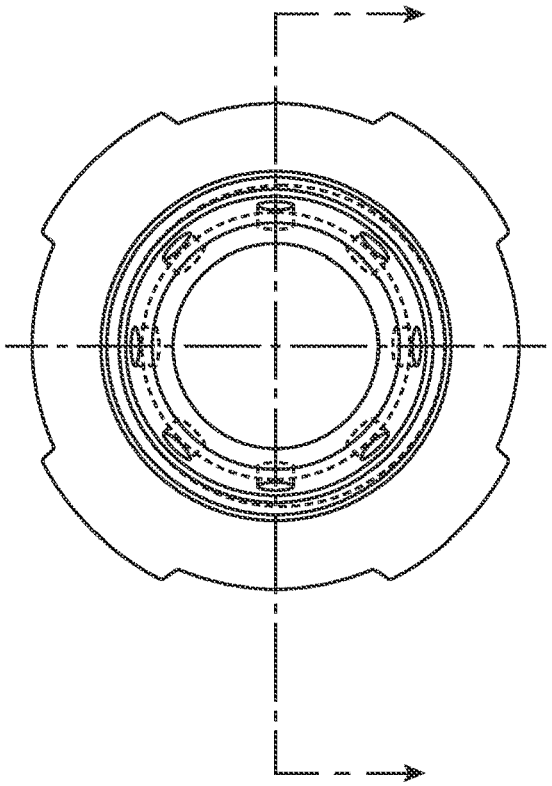

Exemplary nozzle 110 may be cylindrical in shape (FIG. 2), and comprises a 1½ in. Schedule 40 pipe (about 1.85 in. O.D.) and is preferably fabricated using at least one of Type 304 Stainless Steel, Type 316 Stainless Steel, and Type 310 Stainless Steel. The exemplary nozzle may be between about 5 in. and about 6 in. in length. Pilot tubing 102 may be removably connected to nozzle 110 at first inlet 201 located at bottom (inlet) end 203. Fire path tubing 101 may be connected to nozzle 110 at second inlet 202, which may be in the form of a slotted opening located on the cylindrical surface 204 of nozzle 110. Inlet 201 is disposed substantially orthogonal relative to inlet 202; that is, the plane of inlet 201 and that of 202 are substantially orthogonal to each other. Inlet 202 may be of various shapes (e.g., oval, cylindrical, rectangular) and is preferably in the shape of a slotted opening with radial ends as shown in FIG. 2A. The orthogonal orientation of the fire path tubing entry at inlet 202 relative to the pilot tubing entry prevents rain from entering the fire path tubing and subjecting the HSI element to thermal shock. As a result, the durability of the HSI element may be increased from a few weeks to several years. Pilot fuel/air mixture distributing element 205 (FIG. 2D) is inserted into nozzle 110 at inlet end 203 and welded in place. End 206 is adapted to receive pilot line 102, for example, using a ¾ in. NPT threaded connector. Fuel/air mixture flows through neck region 208 of element 205 and exits through throat region 209 and out of end 207. Neck region may be about 0.55 in. in length and about 0.82 in. in diameter, but other suitable dimensions may also be used. Throat region 209 may be about 0.45 in. in length and between about 0.69 in. to 0.75 in. in diameter at end 207, but other suitable dimensions may also be used. The velocity of the fuel/air mixture exiting from the pilot line 102 increases as it flows through throat region 209 and exits at end 207 and may be controlled using a plurality of openings 210, which are disposed in throat region 209. Openings (or holes) 210 are preferably about 0.125 in. in diameter, but other suitable dimensions may also be used. The pilot tubing fuel/air mixture is then ignited by the flame segments entering slotted opening 202 of nozzle 110 and provides a reliable pilot flame exiting at end 211 for the combustion of waste gases in the flare stack. End 207 is located less than about 0.1 in. to 0.2 in. below the bottom radial end 214 of inlet 202. It also prevents the extinguishing of the flame segments that enter nozzle 110 through slotted opening 202 prior to contacting with the fuel air mixture leaving exit 207. A plurality of holes 212, each about 0.375 in. in diameter, are also provided on the cylindrical surface of nozzle 110 to draw in air to stabilize the flame and to prevent the flame from lifting off the nozzle. The exemplary nozzle as disclosed herein is typically rated at 60,000 BTU/h at 10 psig when 1000 BTU/cu. ft. natural gas is used as the fuel. This rating is dependent on the fuel gas heating value and the gas pressure and is subject to change.

The presence of the pilot flame is detected using thermocouple (e.g., K type) 111 that is disposed outside the pilot line. The thermocouple tip enters nozzle 110 through opening 213, which is preferably drilled after welding insert element 205 in place at end 203 of nozzle 110. Opening 213 is preferably between about 0.3 in. and 0.35 in. in diameter and is more preferably about 0.34 in. in diameter. Thermocouple 111 is positioned such that the thermocouple tip is located at about 2.25 in. above end 203 of the nozzle, which positions the thermocouple tip at approximately below the midpoint of slotted opening 202 (and approximately below the midpoint of the length of the nozzle). As the flame segments from fire path tubing 101 enter through slotted opening 202, it ignites the fuel/air mixture flowing out through insert 205. The thermocouple therefore senses the temperature of the cooler portion of the flame front that generally extends from openings 210 to below the mid-point of slotted opening 202, which is relatively cooler than the adiabatic flame temperature. The measured temperature is typically between about 1000° F. and 1500° F. depending on heating value of the natural gas fuel. Typical flame temperature when measured on the outside surface of the nozzle or when measured upstream of the midpoint of slotted opening 202 ranges from 1600° F. to 2500° F. depending upon the heating value of the natural gas fuel. The thermocouple positioning in exemplary nozzle 110 permits the detection of the pilot flame in nozzle 110 while increasing the durability of the thermocouple. Thermocouple wiring 113 may be directly connected to the BMS or may be routed to the BMS through the casing of igniter 108 as shown in FIG. 1. The thermocouple tip may also enter through an opening similar to openings 212 on the cylindrical surface of the nozzle 110, such that the tip is positioned at approximately below the midpoint of slotted opening 202. In this case, a portion of the thermocouple near the nozzle entry point would be bent and then positioned to run parallel to the pilot tubing.

In an alternate embodiment, the thermocouple tip may also be positioned on the outside surface of nozzle 110 below the midpoint of slotted opening 202. The tip may be inserted in a thermowell suitable affixed by welding or other means to the outer surface of the nozzle to protect the tip from atmospheric conditions (wind, rain etc.).

In an exemplary pilot flame light-off sequence for pilot assembly 100, the sequence is started by energizing the HSI igniter 108 over an ignition period. The ignition period is preferably between about 8 seconds and about 15 seconds. Igniter 108 is preferably using a DC voltage of about 12 volts to about 24 volts. The HSI igniter temperature rapidly increases to auto-ignition temperature of the fuel. The burner management system (BMS) then initiates fuel flow to pilot assembly 100. Upon ignition of the fuel/air mixture exiting from mixer 105, a plurality of flame segments is produced in fire path tubing 101, which travel up tubing 101, enter nozzle 110 through slotted opening 202, and ignites the pilot tubing fuel/air mixture exiting element 205 in nozzle 110. After an interval period, the BMS measures the change in flame temperature ($\Delta T$) in nozzle 110 relative to ambient temperature using the signal from thermocouple 111. Preferably the interval period is about 30 seconds. A $\Delta T$ value above a predetermined set point temperature indicates the presence of a pilot flame in nozzle 110. The predetermined temperature (set point) is preferably about 100° C. The values of $\Delta T$, ignition period, and interval period as indicated above are provided as examples only and other suitable values may be utilized and fall within the scope of the disclosed method. If $\Delta T$ is less than the predetermined set point temperature, ignition of the pilot fuel/air mixture failed to occur in nozzle 110. The BMS shuts off the fuel flow to the pilot assembly and the light-off sequence is repeated again. If ignition was successful, the BMS monitors flame temperature at intervals of about 10 seconds. A maximum temperature measured by the thermocouple is recorded. The pilot flame temperature typically levels off at 1000° F. to 1500° F. (maximum temperature) depending on the heating value of the fuel. A decrease in temperature by at least 1% of maximum temperature indicates the absence of a flame. The BMS then shuts off fuel flow and the sequence is repeated again up to three times. The BMS shuts off the fuel to the pilot assembly if a pilot flame is not sensed. Once a stable pilot flame is sensed by the BMS, ignitor 108 remains in a de-energized state. In this state, fuel/air mixture continues to flow through fire path tubing 101. A solenoid valve (not shown) may be optionally installed upstream or downstream of mixer 105 to cut-off fuel flow to the fire-path tubing after a reliable pilot flame has been established. The solenoid valve may be turned ON/OFF by the BMS and minimizes use of fuel in the pilot assembly.

The HSI igniter may comprise of durable, high temperature materials such as silicon carbide or silicon nitride. HSI assemblies are available from sources that include, but are not limited to, Robertshaw, Honeywell, and the like. These igniters may be energized using 12 to 24 VDC or 120 to 280 VAC. A burner management system (BMS) as disclosed in U.S. application Ser. No. 11/047,794 titled "METHOD, APPARATUS AND SYSTEM FOR CONTROLLING A GAS-FIRED HEATER," which is incorporated by reference herein in its entirety, may be adapted to control the operation of pilot assembly 100.

Figure 3A:
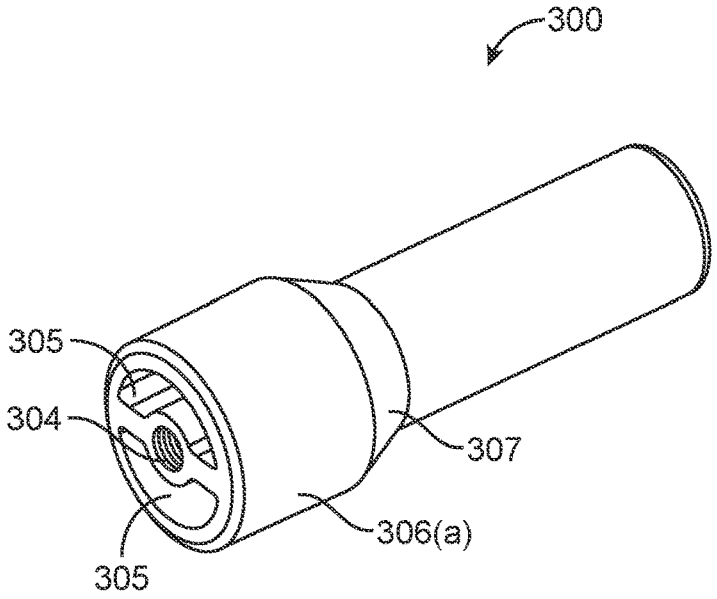
FIG. 3D depicts perspective view of an exemplary fuel/air mixer (top) and prior art mixer (bottom).
FIG. 3E depicts a front view of another exemplary orifice bracket.
Figure 3B:
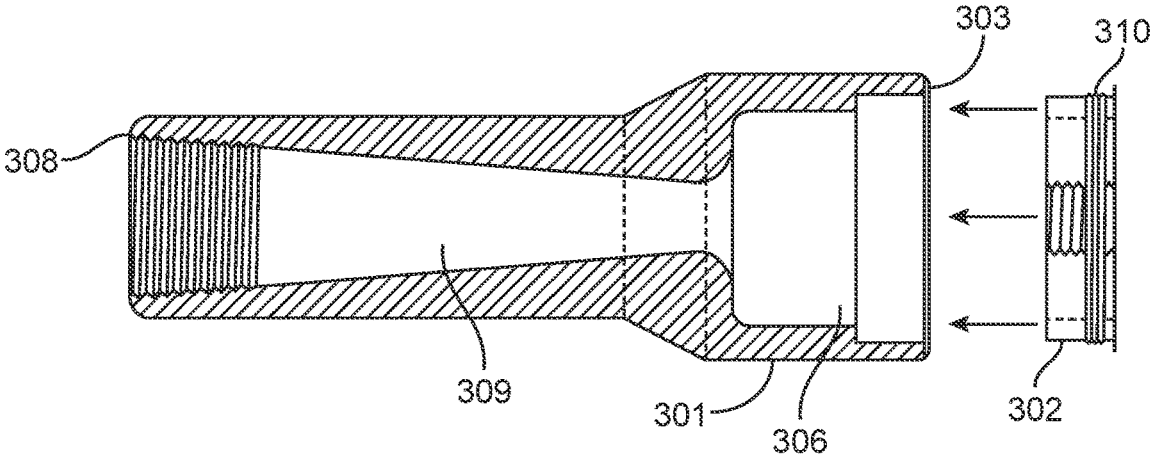
Figure 3C:
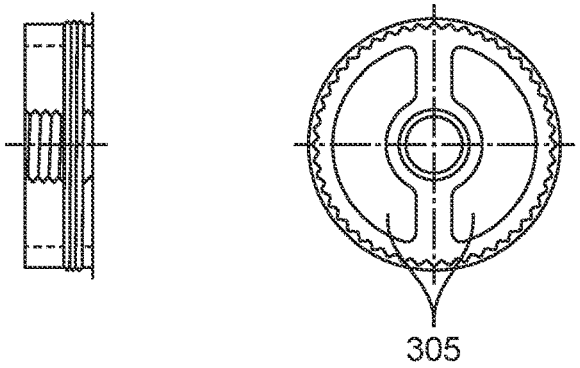
Figure 3D:
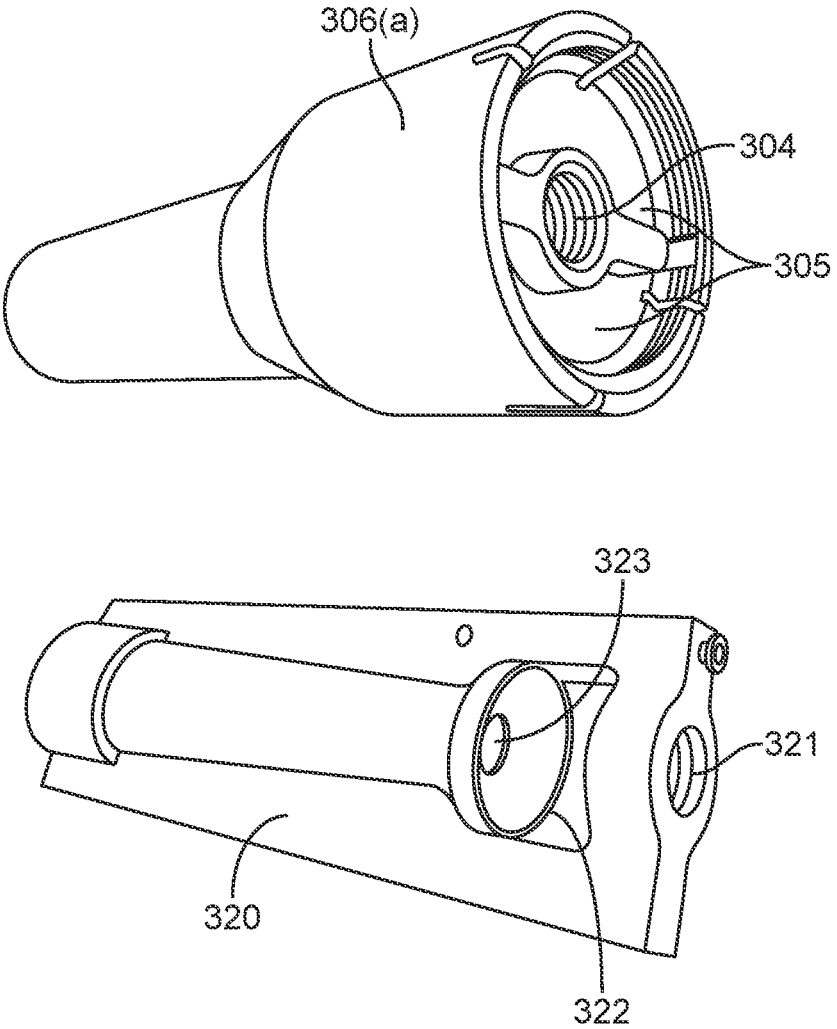
Figure 3E:
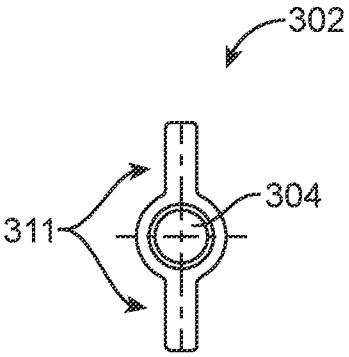

Fuel is pre-mixed with air in mixers 105 and 106 (shown as 300 in FIG. 3) located in fire path tubing 101 upstream of the HSI element and pilot tubing 102 upstream of the nozzle respectively. Exemplary mixers 105 and 106 are venturi type mixers and may be fabricated using at least one of precipitation-hardened aluminum 6061 alloy, cast iron, Type 304 Stainless Steel and cast aluminum. A venturi gas mixer uses Bernoulli's principle in a converging-diverging nozzle and converts the pressure energy of a motive fluid (fuel in this case) to velocity energy at the throat to create a low-pressure zone. This low-pressure zone draws in and entrains the suction fluid (air) into a mixing chamber where it mixes with the fuel. The gas mixture that leaves mixer 300 typically comprises of 10 parts air and 1-part natural gas. As shown in FIG. 3, mixer 300 comprises a venturi component 301, and an orifice bracket 302 that is adapted to mate with inlet end 303 of venturi component 301. The length of mixer 300 between inlet end 303 and outlet end 308 is less than about 10 in. and is preferably between about 5 in. and about 6 in. Orifice bracket 302 may be press-fit into end 303 of component 301 enabled by grooves 310 which may contain a high temperature permanent epoxy adhesive. Orifice bracket 302 may also be adapted to be welded or screwed on to component 301. Orifice components (103 or 104, FIG. 1) are connected to threaded connection 304 (e.g., ¼ in. NPT). As shown in FIG. 3C, the orifice bracket may provide for a plurality of air inlets 305. Alternately, as shown in FIG. 3E, orifice bracket 302 may provide a threaded connection 304 for receiving an orifice component and comprise opposing arms 311 on either side of connection 304 that slide into grooves provided at inlet end 303 to create the plurality of air inlets 305. When installed in fire path tubing 101, fuel enters the mixer 105 (generally shown as 300 in FIG. 3) through the orifice component 103 that is preferably removably connected to threaded opening 304, enters chamber (neck region) 306 and flows through throat 307, diverging section 309, and exits through outlet end 308 into fire path tubing 101. Mixer 106 performs the same function for fuel feed into pilot tubing 102. As the fuel flows through throat 307, it draws in air through the plurality of air inlets 305. The ratio of the throat area to the fuel inlet area ($A_t/A_f$) generally controls the pressure loss through the venturi mixer. $A_t/A_f>0.6$ is desired to minimize pressure loss. In exemplary mixer 300, $A_t/A_f$ is about 1. Further, as shown in FIG. 3D, wall 306(*a*) of mixer 300 at inlet end 303 is in the form of a skirt (flared out) such that it encloses at least 50% of the length the orifice component. The length of orifice component (e.g., 103, 104) is about 2 in. When the orifice component is installed in mixer 300 at connection 304, it extends out of end 303 by about 0.8 inch. This ensures that wind does not shear-off the orifice component, especially when the pilot assembly is located at 50 ft. or more above grade level. In contrast, as shown in the prior art mixer 320 in FIG. 3D, orifice component enters through hole 321, passes through opening 322 which is exposed to ambient conditions and then connects to the mixer at screwed connection 323. The orifice component in mixer 320 is therefore substantially exposed to ambient conditions and is susceptible to shearing-off during windy conditions. Breakage or shearing-off of the orifice component will stop fuel flow to the pilot assembly and cause flame out.

The BMS may also be used to measure the resistance of HSI element 108 to check the health of the HSI element. Aging of the resistance wires may occur at high temperatures, due to cyclic operation, and possibly due to some carbon formation. The resistance of the HSI element is also a function of the age of the HSI element. Aging generally causes an increase in the resistance of the HSI element. The resistance of a fresh HSI element is about 2 ohms, and more typically between 1.6 and 2.4 ohms at a reference temperature of 50° C. An aged igniter element is characterized by a resistance of about 4.5 ohms at a reference temperature of 50° C. An increase in measured resistance at a reference temperature would suggest that the heating element is aging. As a remedial measure, the energizing voltage to the HSI element may be increased in steps of about 0.5 volts (when DC voltage is used) to compensate for the aging of the heating element. Increasing the energizing voltage is warranted if the measured resistance at a reference temperature exceeds the baseline resistance by more than 50%, and preferably by more than 75% to compensate for ageing of the hot igniter surface assembly. If this action fails, replacement of the HSI element would be required. The control methods in the burner management system can also keep track of the service time of the HSI element and increase resistance accordingly to offset the effects of aging to achieve a predetermined ignition temperature.

Alternately, instead of using an HSI element 108, flame segments in the fire path tubing of exemplary pilot assembly 500 may be generated using a spark igniter 504 (FIG. 5). Similar to pilot assembly 100, pilot assembly comprises fire path tubing 501 and pilot tubing 502. The tips of the spark igniter may be installed in the air/fuel mixture path flowing through the fire path tubing that is disposed substantially parallel to pilot tubing 502. The spark igniter wiring and thermocouple 511 wiring 513 are routed to a BMS that is adapted to control a spark ignition pilot assembly. Mixers 505 and 506 and nozzle 510 of pilot assembly 500 may be substantially similar those previously described for use in pilot assembly 100. Spark igniters generally require frequent maintenance to remove soot build up and/or to adjust the gap between the rods. The pilot assembly with a spark igniter would require to be periodically lowered to grade level for checking the gap between the sparking rod tips.

In an exemplary pilot flame light-off sequence for pilot assembly 500, the sequence is started by energizing the spark igniter 504. Igniter 504 is preferably energized using a DC voltage of about 12 volts to about 24 volts. The burner management system (BMS) then initiates fuel flow to pilot assembly 500. Upon ignition of the fuel/air mixture exiting from mixer 505, a plurality of flame segments is produced in fire path tubing 501, which travel up tubing 501, enter nozzle 510 and ignites the pilot tubing fuel/air mixture in nozzle 510. After an interval period, the BMS measures the change in flame temperature (ΔT) in nozzle 510 relative to ambient temperature using the signal from thermocouple 511. Preferably the interval period is about 30 seconds. A ΔT value above a predetermined set point temperature indicates the presence of a pilot flame in nozzle 510. The predetermined temperature (set point) is preferably about 100° C. The values of ΔT and interval period as indicated above are provided as examples only and other suitable values may be utilized and fall within the scope of the disclosed method. If measured ΔT is less than the predetermined set point temperature, ignition of the pilot fuel/air mixture failed to occur in nozzle 510. The BMS shuts off the fuel flow to the pilot assembly and the light-off sequence is repeated again. If ignition was successful, the BMS monitors flame temperature at intervals of about 10 seconds. The pilot flame temperature typically levels off at 1000° F. to 1500° F. depending on the heating value of the fuel. A decrease in temperature by at least 1% of maximum temperature indicates the absence of a flame. The BMS then shuts off fuel flow and the sequence is repeated again up to three times. The BMS shuts off the fuel to the pilot assembly if a pilot flame is not sensed. Once a stable pilot flame is sensed by the BMS, ignitor 504 remains in a de-energized state. In this state, fuel/air mixture continues to flow through fire path tubing 501. A solenoid valve (not shown) may be optionally installed upstream of mixer 505 to cut-off fuel flow to the fire-path tubing after a reliable pilot flame has been established. This solenoid valve may be turned ON/OFF by the BMS and minimizes use of fuel in the pilot assembly.

In another exemplary pilot assembly, the fire path tubing and the pilot tubing in the pilot assembly may be arranged as concentric tubes. In one embodiment of this pilot assembly, the pilot tubing may comprise the inner tubing and fire path tubing may comprise the outer tubing in the concentric arrangement. In another embodiment, the inner tube may comprise the fire path tubing, which would be protected from ambient conditions by the outer pilot tubing. Various options to connect the outlet end of the pilot tubing and the outlet end of the fire path tubing to the pilot nozzle are within the scope of this disclosure. Preferably, the fire path tubing entry into the nozzle is substantially orthogonal to the pilot tubing entry into the nozzle as previously described. The exemplary nozzle and mixer designs may be utilized in this exemplary pilot assembly.

Further, the exemplary pilot systems disclosed above may be modified for use in combustors or enclosed ground flares. An exemplary pilot assembly 600 (FIG. 6) for use in enclosed ground flares, may comprise fire path tubing 601 and pilot tubing 602 that are disposed substantially parallel to each other. The tubings may be generally ¾ in. pipe and made of Type 304 Stainless Steel. Tubings made of other alloys such as Type 316 Stainless Steel, Inconel, and the like may be used. The fuel to the pilot assembly is split into two streams and fed to fuel inlet orifice component 604 fluidly connected to fire path tubing and to fuel inlet orifice component 605 fluidly connected to the pilot tubing. Splitting of fuel flow to the pilot tubing and the fire path tubing in a desired ratio is achieved by selecting different orifice sizes. Preferably, 70% of the fuel feed is routed to the pilot tubing. To achieve this split the size of orifice component 604 may be about 0.040 in. and that of orifice component 605 may be about 0.025 in. Orifice components 604 and 605 are disposed at the bottom end (inlet end) of mixers 606 and 607 respectively. In each mixer, fuel is premixed (naturally aspirated) with air as the fuel flows through the mixer. Downstream of the mixers, fire path tubing 601 and pilot tubing 602 are bent such that the sections of each tubing upstream and downstream of the bend portions 608 and 608' are disposed substantially orthogonal to each other. Fuel filters (Y strainers) 609 and 609' may be disposed upstream of the bend components or fittings to serve as flame arrestors and to prevent the flame segments from propagating back and escaping out of mixers 606 and 607. Fittings such as the orifice component, mixer, flame arrestors, bend components (connectors) disposed in each of the fire path tubing 601 and pilot tubing 602 may be considered to be part of the fire path tubing and pilot tubing, respectively. Similarly, HSI housing fitting 611 may be considered to be part of the fire path tubing.

Pilot assembly 600 may be between about 2 ft. and about 5 ft. in length as measured from the tip of nozzle 603 to the fuel supply inlet at the entry of the pilot assembly. Fuel to the pilot assembly may be off-gas from treatment units such as water/oil separators. Water/oil separators may be physical separators or heater treaters. The fuel is typically dehydrated and fed to the pilot assembly at a pressure of about 10 psig to 14 psig. Waste gases from oil storage or water storage tanks at well sites may vary in composition and are available at low pressure (about 0.5 to 8 ounce per sq. in.). Waste gases are flared or combusted in the enclosed ground flares. Because of varying gas composition and low pressures, waste gases are generally not suitable to be used as a fuel in pilot systems. The fuel/air mixture exits mixer 606 in fire path tubing 601 and is ignited by a hot surface igniter (HSI) 610 (FIG. 7) disposed in fitting 611. Ignitor 610 may be inserted into fitting 611, which may be, a T-shaped or Y-shaped fitting or a suitable combination of fittings fluidly connected to tubing 601 and may be sealed to fitting 611 using electrical seal-off cement that allows wiring 618 to pass through. Alternately, igniter 610 may be inserted into a suitable opening provided in fire path tubing 601. Igniter 610 is preferably positioned such that tip 612 does not extend inside tubing 601 into the flow path of the fuel/air mixture. As shown on FIG. 7, tip 612 is offset from the wall of the fire path tubing that receives the HSI element and subsequently from the flow path of the fuel/air mixture. Tip 612 may be offset from the wall or from the face of fitting 611 that is substantially parallel to the fire path tubing wall that connects to fire path tubing 601. The offset may be about 0.8 in. from the wall of the fire path tubing that receives the HSI element. The offset may be between about 0.5 in. and about 1.05 in. The positioning of the HSI tip as described above does not impede the flow of fuel/air mixture in fire path tubing 601. It also generates a plurality of flame segments by the ignition of the fuel/air mixture by energized HSI igniter 610, which travel through tubing 601 towards exit 614 fluidly connected to nozzle 603. Flame segments comprise one or more flame regions separated by one or more slugs of fuel/air mixture that flow through tubing 601 and towards nozzle 603. When igniter 610 is not energized, a continuous flow of fuel/air mixture is realized in tubing 601. By off-setting the HSI tip as described above, the tip stays at ignition temperature even when fuel-air mixture is flowing through fire path tubing 601 without getting quenched. Off-setting the HSI tip also protects the HSI tip from the extreme flame temperatures of the flame segments that would reduce HSI durability and require replacing the HSI element within months. Pilot assemblies with the HSI igniter tip located in the fuel-air mixture flow path are unreliable as flame segment generators, because the HSI tip will be quenched by the cooler fuel-air gas mixture. Placing the HSI tip in the fuel-air gas flow would reduce the ignition temperature to below the practical ignition point and cause a misfire that would allow natural gas to escape without being burnt into the atmosphere emitting methane into the atmosphere and violate environmental regulations.

Figure 10:
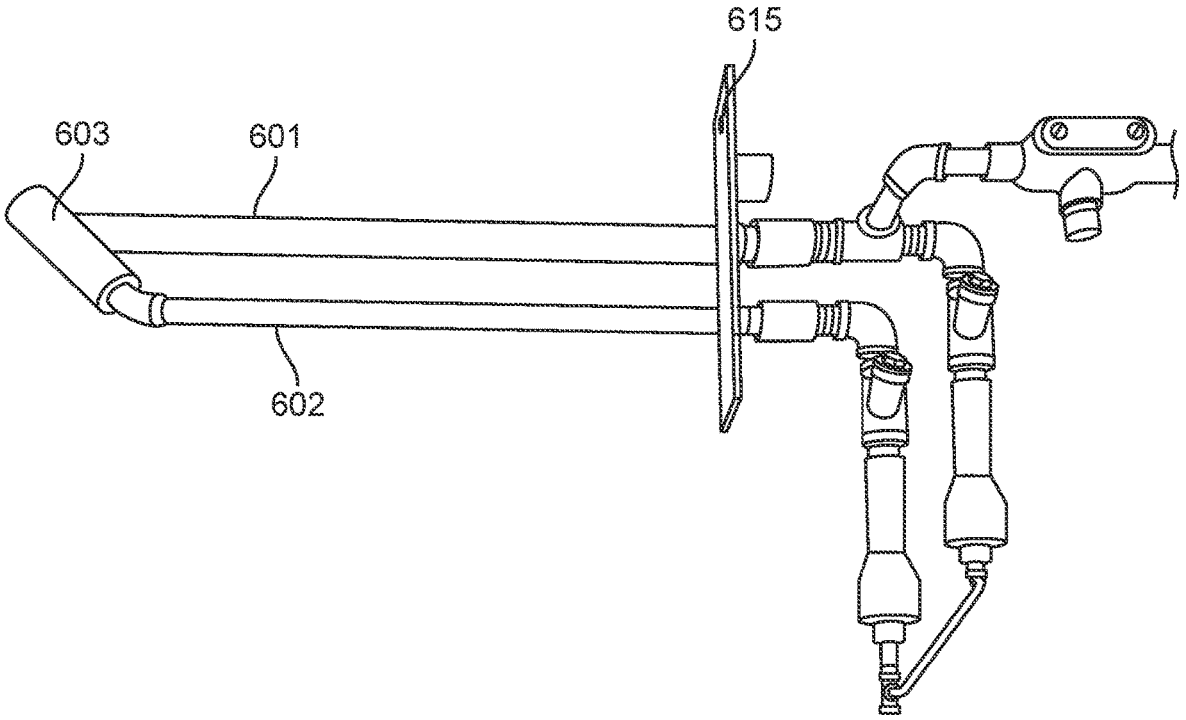

Details related to exemplary igniter 610 were previously disclosed (FIG. 4). Details related to exemplary nozzle 603 were previously disclosed (FIGS. 2A-E). Pilot tubing 602 may be removably connected to nozzle 603 at first inlet 613. Fire path tubing 601 may be connected to nozzle 603 at second inlet 614, which may be in the form of a slotted opening located on the cylindrical surface nozzle 603. Inlet 613 may be disposed substantially orthogonal relative to inlet 614. The pilot tubing fuel/air mixture is ignited by the flame segments entering slotted opening 614 of nozzle 603 and provides a reliable pilot flame exiting from nozzle 603. Fire path tubing 601 and pilot tubing 602 downstream of HSI igniter fitting 611 then pass-through suitable holes provided in plate or gasket 615 (FIGS. 8A-B) and into the combustion section of ground flare 616 (FIG. 9). The pilot flame exiting from nozzle 603 ignites the waste gas entering ground flare 616 through waste gas pipe 617 as the waste gas exit the burners provided in the combustion section of ground flare 616. Waste gas pipe 617 may be a 3 in. pipe. Plate 615 may be in the form of a flange and configured to form a seal with the combustion section opening in ground flare 616 using suitable gaskets and the like. Plate 615 may also be rectangular in shape depending on the shape of the combustor section opening (FIG. 10). Depending on the configuration of the combustor section in ground flare 616, nozzle 603 may be disposed at an angle relative to the longitudinal axes of fire path tubing 601 and pilot tubing 602 (FIG. 10) downstream of plate 615. The nozzle shown in FIG. 10 may be used if the pilot assembly is disposed under the burners in enclosed vertical ground flare 616. Ignition wiring 618 (FIG. 6) connected to the HSI element 610 may be rated to withstand at least 1000° F. Wiring 618 may be routed to a burner management system (BMS) through junction box 619. Details of suitable burner management systems and methods for operating the exemplary pilot systems were previously disclosed. When the HSI element is energized, it heats up to 2800° F. and ignites fuel/air mixture to generate flame segments in tubing 601. In FIG. 9, the orientation of the legs or sections of fire path tubing 601 and pilot tubing 602 when assembled in ground flare 616 are shown to be perpendicular to the ground 621. Alternate orientations are within the scope of the exemplary pilot system 600 for use in enclosed gas flares. For example, assembly 600 may be rotated such the fire path tubing 601, pilot tubing 602 and HSI housing component 611 are disposed parallel to the ground.

The presence of the pilot flame may be detected using thermocouple (e.g., K type) 620 that is disposed outside pilot line 602 and enters the bottom of nozzle 603 (FIG. 8B) and is positioned such that the thermocouple tip is disposed to sense the temperature of the cooler portion of the flame as previously disclosed (FIG. 2A and related description), which is relatively cooler than the adiabatic flame temperature. The thermocouple positioning in exemplary nozzle 603 permits the detection of the pilot flame in nozzle 603 while increasing the durability of the thermocouple. Thermocouple 620 may also be routed to a suitable BMS through junction box (or conduit) 619. The thermocouple tip may also enter through an opening on the cylindrical surface of the nozzle 603. In this case, a section or part of the thermocouple near the nozzle entry point would be bent and then positioned to be disposed parallel to the pilot tubing. Fuel flow into fire path tubing 601 and pilot tubing 602 is pre-mixed with air in mixers 606 and 607 (shown as 300 in FIG. 3 and related description) respectively, located in fire path tubing 601 upstream of the HSI element and pilot tubing 602 upstream of nozzle 603 respectively. Exemplary mixers 606 and 607 may be venturi type mixers and may be fabricated using at least one of precipitation-hardened aluminum 6061 alloy, cast iron, Type 304 Stainless Steel and cast aluminum.

The pilot assemblies for elevated flare stacks disclosed herein are intended for igniting well site off gases to meet U.S. EPA 0000a regulations. The pilot assemblies are located at an elevation of typically between about 10 ft and 50 ft. The exemplary pilot assemblies disclosed and claimed herein permit reliable light-off of the pilot and for the pilot flame to stay lit thereby permitting oil and gas production companies to reduce their greenhouse gas emissions and meet the EPA's guidelines on reducing emissions. Furthermore, a key requirement of EPA 0000a regulation is recording the temperature profile of the pilot assembly to produce a temperature chart for inspection to show that the pilot remained lit during operation. The exemplary pilot assembly and nozzle and BMS systems and methods disclosed herein provides for the temperature measurements required to meet EPA 0000a regulations. The placement of the thermocouple tip in nozzle 603 as disclosed above protects the thermocouple from the extreme temperatures that would cause premature failure of the thermocouple.

The length of exemplary pilot assemblies for elevated flare stacks may be between about 2 ft. and about 20 ft. as generally measured from the nozzle tip to the fuel supply inlet point. The length of exemplary pilot assemblies for enclosed ground flares may be between about 2 ft. and about 5 ft. For exemplary pilot assemblies less that about 8 ft. (96 in.) in length, the HSI element tip offset may be about 0.8 in. The HSI element tip may be offset by between about 0.5 in. and about 1.05 in. Without being bound by any particular theory, for exemplary pilot assemblies that exceed about 16 ft. (200 in.) in length, the HSI element tip offset may be about 3.1 in. The HSI element tip may be offset by between about 2.85 in. and about 3.35 in. By off-setting the HSI tip, as described above, the tip stays at ignition temperature even when fuel-air mixture is flowing through the fire path tubing of the pilot assembly without getting quenched. Off-setting the HSI tip also protects the HSI tip from the extreme flame temperatures of the flame segments that would reduce HSI durability and require replacing the HSI element within months. Pilot assemblies with the HSI igniter tip located in the fuel-air mixture flow path are unreliable as flame segment generators, because the HSI tip will be quenched by the cooler fuel-air gas mixture. Placing the HSI tip in the fuel-air gas flow reduces the ignition temperature to below the practical ignition point and causes a misfire that would allow natural gas to escape without being burnt into the atmosphere emitting methane into the atmosphere and violate environmental regulations.

Exemplary pilot assembly 600 for use in enclosed ground flares may be about 30 in. in length. Exemplary pilot assembly 100 for elevated flare stacks may be at least about 72 in. (6 ft.) in length for use in elevated flare stacks that are between about 20 ft. and 60 ft. in height. Some elevated flare stacks may produce higher amounts of radiant heat, which would require the tubing fittings (e.g., fuel/air mixers, reducer components and the like), HSI connector, and wiring to be lowered to above ground level (grade), which in turn would increase the length of the pilot assembly to 8 ft. or more. Pilot assemblies of length of about 200 in. (16 ft. to 17 ft.) to be used with 20 ft. elevated flare stacks may be required to enable maintenance to be carried out at ground level to avoid costs associated with lift equipment for maintenance technicians and also to increase personnel safety during rain and high wind conditions.

The exemplary pilot assemblies and pilot nozzles disclosed herein significantly simpler in design compared to the pilot assembly disclosed in U.S. Pat. No. 6,840,761 titled "ULTRA-STABLE FLARE PILOT AND METHODS." Unlike pilot (26) and windshield (48) disclosed in U.S. Pat. 6,840,761, the exemplary pilot assemblies disclosed herein, do not incorporate flame stabilizer (44), baffles (64, 66), vertical wall (58), and a variety of holes (58, 60, 68, 78). The exemplary pilot assemblies described herein may be used in elevated flare stacks that exceed 100 ft. in height. Nozzle 110 comprises insert 205 as previously described to distribute the flame such that the flame propagates through the length of nozzle 110. The pilot assembly is capable of staying lit during high wind and rain. The nozzle is between about 5 in. and about 6 in. in length and the cylindrical nozzle design shields the flame from cross winds. Further, since the fuel to the pilot assembly is at fed at a pressure of about 10 psig and 14 psig, the fuel velocity through the exemplary pilot assemblies assists with flame stability even during high wind conditions. During heavy rain, water droplets that enter nozzle 110 may drain through pilot tubing 102 and through openings 305 in mixer 306. Fire path tubing 101 may be gently bent before being fluidly connected to the cylindrical surface of nozzle 110 at an entry point that is substantially orthogonal to the entry point of pilot tubing 102 (FIG. 2A, 8B). As a result, rainwater is substantially prevented from entering fire path tubing 101.

Exemplary pilot system 600 may also be used as a pilot in the combustion section of process vessel burners. In process vessels, reliable and efficient sparkless igniters for treating and processing oil and gas produced at well sites are needed. Crude oil is often extracted from oil wells as an oil-water emulsion that may also contain significant amounts of free water and natural gas. Gas is separated from the oil-water emulsion and free water using a gas separator. Free water may be removed using water knock-out vessels, which are also known as phase separators. The resulting oil-water emulsion, with minimal amounts of gas and free water, may be sent to process vessels such as treaters (also referred to as heater treaters) to separate water from the emulsion. The treater dehydrates or dewaters the produced crude oil to a required basic sediment and water (BS&W) level. Oil-water separation may be enhanced by heating, adding emulsion breaking chemicals, coalescing media, and/or electrostatic fields. Most crude oils are treated to a range of 0.2% to 3.0% BS&W as determined by the ASTM Standard Test No. D96-82. Treaters typically contain water knock-out and de-gassing zones to produce crude oil of desired quality. Heating lowers the viscosity of the oil making it easier for the water to settle. It also aids in the coalescing of the water droplets, which facilitates water removal. Heater treaters are used where the emulsion cannot be broken using just retention, quiescence, and chemical de-emulsifiers. The fuel to the pilot igniter in process vessels at well sites may be natural gas. Natural gas is a byproduct formed during oil extraction from oil wells and is typically referred to as wellhead gas. Wellhead gas comprises a mixture of methane, ethane, propane, nitrogen, carbon dioxide, and water. Efficient operation of the treater depends on efficient igniter performance. Igniter performance depends on many factors including igniter design, durability of ignition elements, and proper adjustment of fuel gas pressure, which in turn controls fuel and air flow rates to the igniter. Ignition may be accomplished with spark igniters or sparkless igniters. In the case of spark ignition, the sparking tips require periodic cleaning to remove carbon accumulation formed as a byproduct of combustion. Further, periodic adjustment is required to maintain the spark gap between the two electrodes in a spark igniter. Therefore, there is an increasing interest in using sparkless ignition in treater burners.

The Abstract is provided to comply with 37 C.F.R. § 1.72(b), to allow the reader to determine quickly from a cursory inspection the nature and gist of the technical disclosure. It should not be used to interpret or limit the scope or meaning of the claims.

Although the present disclosure has been described in connection with the preferred form of practicing it, those of ordinary skill in the art will understand that many modifications can be made thereto without departing from the spirit of the present disclosure. Accordingly, it is not intended that the scope of the disclosure in any way be limited by the above description.

It should also be understood that a variety of changes may be made without departing from the essence of the disclosure. Such changes are also implicitly included in the description. They still fall within the scope of this disclosure. It should be understood that this disclosure is intended to yield a patent covering numerous aspects of the disclosure both independently and as an overall system and in both method and apparatus modes.

Further, each of the various elements of the disclosure and claims may also be achieved in a variety of manners. This disclosure should be understood to encompass each such variation, be it a variation of an implementation of any apparatus implementation, a method or process implementation, or even merely a variation of any element of these.

Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this disclosure is entitled. It should be understood that all actions may be expressed as a means for taking that action or as an element which causes that action. Similarly, each physical element disclosed should be understood to encompass a disclosure of the action which that physical element facilitates.

In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Further, the use of the transitional phrase "comprising" is used to maintain the "open-end" claims herein, according to traditional claim interpretation. Thus, unless the context requires otherwise, it should be understood that variations such as "comprises" or "comprising," are intended to imply the inclusion of a stated element or step or group of elements or steps, but not the exclusion of any other element or step or group of elements or steps. Such terms should be interpreted in their most expansive forms so as to afford the applicant the broadest coverage legally permissible.

What is claimed is:

1. A pilot assembly for igniting waste gases in enclosed ground flares, the pilot assembly comprising:

a fire path tubing having an inlet end and an outlet end and having a fuel inlet disposed at the inlet end;

a pilot tubing having an inlet end and an outlet end and having a fuel inlet disposed at the inlet end, wherein each of the fire path tubing and pilot tubing are characterized by a bend such that the inlet end and outlet end of each tubing are not disposed along a straight line;

a pilot nozzle configured to receive the pilot tubing at a first nozzle inlet and the fire path tubing at a second nozzle inlet; and, a hot surface igniter (HSI) element disposed at a distance away from the nozzle and in fluid communication with the fire path tubing, wherein the tip of the HSI element is offset such that the tip does not extend inside the fire path tubing into a flow path of fuel/air mixture, and wherein a plurality of flame segments generated in the fire path tubing by igniting a first premixed fuel/air mixture by the HSI element travel through the fire path tubing and ignites a second premixed fuel/air mixture entering the nozzle through the pilot tubing to create a pilot flame for igniting waste gases.

2. The pilot assembly of claim 1, wherein the pilot tubing is disposed substantially parallel to the fire path tubing.

3. The pilot assembly of claim 1, wherein the inlet end and outlet end of each tubing are disposed substantially orthogonal to each other.

4. The pilot assembly of claim 1, wherein the first and second nozzle inlets are disposed substantially orthogonal to each other.

5. The pilot assembly of claim 1, wherein the pilot nozzle is configured to receive a thermocouple to detect the presence of the pilot flame.

6. The pilot assembly of claim 5, wherein the pilot nozzle is adapted to receive the thermocouple through an opening disposed near the first nozzle inlet, and wherein the tip of the thermocouple is disposed below the midpoint of the length of the nozzle.

7. The pilot assembly of claim 1, wherein the hot surface igniter element is cylindrical.

8. The pilot assembly of claim 1, wherein the HSI element is energized using DC voltage.

9. The pilot assembly of claim 1, wherein the HSI element tip is offset by about 0.8 in.

10. The pilot assembly of claim 1, wherein the HSI element tip is offset by between about 0.5 in. and about 1.05 in.

11. The pilot assembly of claim 1, wherein the pilot nozzle is cylindrical in shape.

12. The pilot assembly of claim 1, wherein the pilot nozzle is made of at least one of Type 304 Stainless Steel, Type 316 Stainless Steel, and Type 310 Stainless Steel.

13. The pilot assembly of claim 1, further comprising a first venturi mixer disposed in the fire path tubing upstream of the HSI element and a second venturi mixer disposed in the pilot tubing upstream of the pilot nozzle, wherein the first and second venturi mixers provide the first and second fuel/air mixtures to the fire path tubing and pilot tubing respectively.

14. The pilot assembly of claim 13, wherein each of the first and second venturi mixer comprises:

an inlet end and outlet end disposed opposite to the inlet end;

an orifice bracket adapted to mate with the inlet end of the venturi mixer and adapted to receive an orifice component connected to a fuel supply;

a neck region disposed downstream of the inlet end and in fluid communication with a throat region, wherein the diameter of the neck region is greater than the diameter of the throat region; and, a diverging section disposed between the throat region and the outlet end of the mixer, wherein at least 50% of the length of the orifice component is enclosed within the walls of the mixer at the inlet end.

15. The pilot assembly of claim 14, wherein each of the first and second venturi mixer is made of at least one of precipitation-hardened aluminum 6061 alloy, cast iron, Type 304 Stainless Steel, and cast aluminum.

16. The pilot assembly of claim 1, wherein the pilot nozzle further comprises a fuel/air mixture distributing element insert adapted to receive the outlet end of the pilot tubing, wherein the distributing element insert comprises:

a neck region with a first end and a second end disposed opposite to the first end, wherein the first end is adapted to receive the pilot tubing; and, a throat region having a first end connected to the second end of the neck region and a second end, wherein the diameter of the throat region at the first end is greater than the diameter of the throat region at the second end, and wherein fuel/air mixture flows through the neck region and exits through the second end of the throat region.

17. The pilot assembly of claim 16, wherein the throat region of the fuel/air mixture distributing element insert further comprises a plurality of holes disposed below the second end.

18. The pilot assembly of claim 17, wherein the diameter of the holes is about 0.125 inch.

19. A pilot flame light-off sequence for the pilot assembly of claim 5, the sequence comprising:

energizing the HSI element during an ignition period;

initiating fuel flow to the pilot assembly and generating a plurality of flame segments in the fire path tubing by igniting the fuel/air mixture using the energized HSI element, wherein the plurality of flame segments enters the pilot nozzle and ignites the fuel/air mixture entering the pilot nozzle from the pilot tubing;

measuring a change in flame temperature ($\Delta T$) in the pilot nozzle relative to ambient temperature using the thermocouple after an interval period; and, if the $\Delta T$ is less than a predetermined set point temperature, shutting of fuel flow to the pilot assembly and repeating the sequence.

20. The method of claim 19, wherein the ignition period is between about 8 seconds and 15 seconds.

21. The method of claim 19, wherein the predetermined set point temperature is about 100° C.

22. The method of claim 19, wherein the interval period is about 30 seconds.

23. The method of claim 19, further comprising:

measuring the flame temperature at intervals of about 10 seconds if $\Delta T$ is above the predetermined set point temperature;

recording a maximum temperature measured by the thermocouple;

shutting off fuel flow if the flame temperature decreases by at least 1% from the maximum temperature; and, repeating the light off sequence up to three times after which the light-off sequence is terminated if the pilot flame is not sensed.

24. The method of claim 23, wherein the maximum temperature is between about 600° F. and about 1500° F. depending on the heating value of the fuel.

25. A pilot assembly for igniting waste gases in an elevated flare stack, the pilot assembly comprising:

a fire path tubing;

a pilot tubing;

a pilot nozzle configured to receive the pilot tubing at a first nozzle inlet and the fire path tubing at a second nozzle inlet, wherein the first and second nozzle inlets are disposed substantially orthogonal to each other; and, a hot surface igniter (HSD) element disposed at a distance below the second nozzle inlet in fluid communication with the fire path tubing, wherein the tip of the HSI element is offset such that the tip of the HSI element does not extend inside the fire path tubing into a flow path of fuel/air mixture, and wherein the HSI element offset is dependent on the length of the pilot assembly, wherein a plurality of flame segments generated in the fire path tubing by igniting a first premixed fuel/air mixture by the HSI element travel up the fire path tubing and ignites a second premixed fuel/air mixture entering the nozzle through the pilot tubing to create a pilot flame for igniting waste gases flowing through the elevated flare stack.

26. The pilot assembly of claim 25, wherein the length of the pilot assembly is less than about 100 in.

27. The pilot assembly of claim 26, wherein the HSI element tip is offset by between about 0.5 in. and about 1.05 in.

28. The pilot assembly of claim 26, wherein the HSI element tip is offset by about 0.8 in.

29. The pilot assembly of claim 25, wherein the length of the pilot assembly is at least about 200 in.

30. The pilot assembly of claim 29, wherein the HSI element tip is offset by between about 2.85 in. and about 3.35 in.

31. The pilot assembly of claim 29, wherein the HSI element tip is offset by about 3.1 in.

* * * * *